US011788219B2

(12) United States Patent
MacGilbert et al.

(10) Patent No.: US 11,788,219 B2
(45) Date of Patent: Oct. 17, 2023

(54) KNITTED TEXTILE AND METHOD OF FORMING

(71) Applicant: NIKE, Inc., Beaverton, OR (US)

(72) Inventors: John S. MacGilbert, Tigard, OR (US); William C. McFarland, II, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/982,873

(22) Filed: Nov. 8, 2022

(65) Prior Publication Data

US 2023/0126788 A1 Apr. 27, 2023

Related U.S. Application Data

(62) Division of application No. 16/497,015, filed as application No. PCT/US2018/024019 on Mar. 23, 2018, now Pat. No. 11,525,197.

(Continued)

(51) Int. Cl.
*D04B 21/16* (2006.01)
*D04B 1/16* (2006.01)

(Continued)

(52) U.S. Cl.
CPC ..... *D04B 21/165* (2013.01); *A43B 1/04* (2013.01); *D04B 1/16* (2013.01); *D04B 1/24* (2013.01);

(Continued)

(58) Field of Classification Search
CPC . D04B 1/16; D04B 1/165; D04B 1/24; D10B 2401/041; A43B 1/04
See application file for complete search history.

(56) References Cited

U.S. PATENT DOCUMENTS 4,133,191 A 1/1979 Blore et al.
4,785,558 A 11/1988 Shiomura
(Continued)

FOREIGN PATENT DOCUMENTS

CN 102477660 A 5/2012
CN 104032468 A 9/2014
(Continued)

OTHER PUBLICATIONS

Extended European Search Report received for European Application No. 23151107.2, dated Apr. 20, 2023, 12 pages.

*Primary Examiner* — Danny Worrell
(74) *Attorney, Agent, or Firm* — SHOOK, HARDY AND BACON L.L.P.

(57) ABSTRACT

A knitted textile having a first layer including a first yarn with a thermoplastic composition integrally formed with a second layer including a second yarn, the first yarn forming an array of knitted patterns defining voids through the first layer to the second layer. The first layer may be heat treated to form a film. Treatment of the first layer may change zonal and directional tensile properties of the knitted textile. The Poisson's ratio of the knitted textile may be greater than or equal to zero in a first axis and/or a second axis, before and/or after treatment. Articles of apparel, including articles of footwear and garments incorporating the knitted textile, and methods of forming the knitted textiles and articles are disclosed.

20 Claims, 8 Drawing Sheets

Related U.S. Application Data

(60) Provisional application No. 62/483,041, filed on Apr. 7, 2017.

(51) Int. Cl.

| | |
|---|---|
| ***D04B 1/24*** | (2006.01) |
| ***D04B 21/20*** | (2006.01) |
| ***D06C 7/00*** | (2006.01) |
| ***A43B 1/04*** | (2022.01) |

(52) U.S. Cl.

CPC ..... *D04B 21/207* (2013.01); *D06C 7/00* (2013.01); *D10B 2401/041* (2013.01); *D10B 2401/062* (2013.01); *D10B 2403/0114* (2013.01); *D10B 2501/043* (2013.01)

(56) References Cited

U.S. PATENT DOCUMENTS

| | | | |
|---|---|---|---|
| 5,636,533 | A | 6/1997 | Hunneke et al. |
| 6,477,865 | B1 | 11/2002 | Matsumoto |
| 6,723,208 | B1 | 4/2004 | Hansen |
| 7,162,777 | B2 | 1/2007 | Delgorgue et al. |
| 7,306,851 | B2 | 12/2007 | Panse |
| 8,518,840 | B2 | 8/2013 | Hatori et al. |
| 8,733,837 | B2 | 5/2014 | Weinstein et al. |
| 10,151,054 | B2 | 12/2018 | Mueller et al. |
| 11,525,197 | B2 * | 12/2022 | MacGilbert ..... D04B 21/165 |
| 2003/0106346 | A1 | 6/2003 | Matsumoto |
| 2004/0166756 | A1 | 8/2004 | Kurihara et al. |
| 2007/0179255 | A1 | 8/2007 | Vedula et al. |
| 2012/0023631 | A1 | 2/2012 | Fischer |
| 2012/0144698 | A1 | 6/2012 | Mcdowell |
| 2013/0255103 | A1 | 10/2013 | Dua et al. |
| 2014/0310985 | A1 | 10/2014 | Tran et al. |
| 2015/0216254 | A1 | 8/2015 | Podhajny |
| 2019/0062964 | A1 | 2/2019 | Heiner et al. |
| 2021/0381142 | A1 | 12/2021 | Macgilbert et al. |

FOREIGN PATENT DOCUMENTS

| | | | |
|---|---|---|---|
| CN | 204181024 | U | 3/2015 |
| CN | 104562401 | A | 4/2015 |
| CN | 105040258 | A | 11/2015 |
| CN | 105747351 | A | 7/2016 |
| CN | 106235524 | A | 12/2016 |
| EP | 1754814 | A1 | 2/2007 |
| EP | 2649898 | A1 | 10/2013 |
| JP | 2011-157634 | A | 8/2011 |
| KR | 10-2015-0124787 | A | 11/2015 |
| WO | 2014/081680 | A1 | 5/2014 |

* cited by examiner

6E
Fabric 1
S#2
S#3
S#4
Force (N)
20
15
10
5
0
-5
10
20
30
40
50
60
Displacement (mm)
6F
Ext = 0
Ext = 50mm
PR
S#2
+0.32
S#3
+0.40
S#4
+0.09
S#1
6G
Select patterns and knit/weave
6A
Section and Study
6B
Assess the stress/strain response
6C
PR, $\nu = -(\varepsilon_y/\varepsilon_x)$
6D

| | Orientation | Stiffness (N/mm) | Poisson's ratio | Ext = 0 | Ext = 50mm |
|---|---|---|---|---|---|
| Un-fused | 0° | 0.04 | -0.03 |  |  |
| | 90° | 0.39 | +0.14 |  |  |
| | 45° | 0.14 | -0.04 |  |  |
| Fused | 0° | 0.16 | +0.33 |  |  |
| | 90° | 1.40 | +0.37 |  |  |
| | 45° | 0.37 | +0.37 |  |  |

| | Orientation | Stiffness (N/mm) | Poisson's ratio | Ext = 0 | Ext = 50mm |
|---|---|---|---|---|---|
| Un-fused | 0° | 0.21 | +0.31 | | |
| | 90° | 0.23 | +0.31 | | |
| | 45° | 0.19 | +0.49 | | |
| Fused | 0° | 4.44 | +0.43 | | |
| | 90° | 3.66 | +0.24 | | |
| | 45° | 2.87 | +0.59 | | |

Fig. 8

KNITTED TEXTILE AND METHOD OF FORMING

CROSS-REFERENCE TO RELATED APPLICATIONS AND PRIORITY CLAIM

This U.S. application Ser. No. 17/982,873, filed Nov. 8, 2022 is a divisional of U.S. application Ser. No. 16/497,015, filed on Sep. 24, 2019, now issued as U.S. Pat. No. 11,525,197, and entitled "Knitted Textile and Method of Forming," which is a 371 national phase filing of PCT/US2018/024019, filed on Mar. 23, 2018, and entitled "Knitted Textile and Method of Forming," which claims priority benefit of U.S. Provisional Application No. 62/483,041, filed Apr. 7, 2017, all of which are hereby incorporated by reference in their entireties.

BACKGROUND

Field of the Invention

The disclosure relates to textiles, particularly knitted textiles having two or more integrally formed knitted layers, a first layer comprising a yarn including a first thermoplastic composition and a second layer comprising a yarn having a second composition, as well as articles of apparel and sporting equipment incorporating the knitted textiles. Also disclosed are methods of manufacturing the knitted textiles, articles of apparel, and sporting equipment.

Description of the Related Art

Modern textile manufacturing and materials have made it possible to create textiles with improved fit and comfort. Significant improvements in knitting technology, such as disclosed in WO2014/081680, allow formation of a single integrally-formed knitted textile having distinct properties in different regions of the knitted textile, while reducing material waste. Using this technology, it is possible to reduce the number of material elements required to manufacture textiles and articles of apparel incorporating such textiles, while also reducing labor costs and manufacturing time.

The use of yarns having different material compositions also allows for distinct regional behaviors in an integrally-formed knitted textile. For example, a knitted textile may have multiple layers, each incorporating different yarn configurations and knit types. These properties can thus be exploited to introduce variations in the behavior of the finished product.

Many articles of apparel are designed to fit closely to the body. Given the wide range of body types and shapes, it is challenging to design apparel that accounts for regional contours and interspecific variations. In addition, specific areas such as toe caps and heel regions of an article of footwear require increased wear-resistance, while other areas such as waist areas of a shirt or the tongue region of an article of footwear require increased flexibility. A "one size fits all" strategy is likely to leave many users experiencing excessive tightness and discomfort in some areas and excessive wear or looseness in other areas. Similarly, while a material such as cotton may be comfortable against the skin, it may not be suitable for wear-resistance and tends to retain excess moisture, making it undesirable in many applications.

It is desirable to provide improved integrally-formed knitted textiles and articles of apparel with specifically-tailored zonal and directional properties allowing, for example, increased tensile properties in areas and directions where needed and improved wear-resistance or comfort in other areas, with decreased cost and material waste.

BRIEF SUMMARY

In one aspect, a knitted textile with a knitted structure is disclosed, the knitted structure including a first layer with a first yarn having a first thermoplastic composition, and a second layer opposite and integrally formed with the first layer, the second layer comprising a second yarn formed of a second composition.

In some embodiments, the first yarn forms an array of knitted patterns in the first layer, the array of knitted patterns defining voids in the first layer; the second layer with a second yarn, the voids passing through the first layer and to the second layer.

In some embodiments, the first layer has a first surface comprising a film, the film comprising the first yarn in reflowed form, the film forming an array of fused patterns on the first surface, the array of fused patterns defining voids in the first surface, the voids passing through the first layer and to the second layer.

In one aspect, articles of footwear having an upper and sole structure are disclosed, the upper with a knitted textile having a knitted structure.

In some embodiments, the knitted structure has a first layer comprising a first yarn, the first yarn having a first thermoplastic composition, the first layer having a first surface comprising a film, the film comprising the first yarn in reflowed form, the film forming an array of fused patterns on the first surface, the array of fused patterns defining voids in the first surface, a second layer opposite the first layer and integrally formed with the first layer, the second layer having a second yarn formed of a second composition; the voids passing through the first layer and to the second layer.

In one aspect, a method of forming a knitted textile is disclosed.

In some embodiments, the method includes knitting a knitted structure having a first layer with a first yarn, the first yarn having a first thermoplastic composition having a first melting temperature, and a second layer opposite the first layer and integrally formed with the first layer, the second layer comprising a second yarn formed of a second composition having a second melting temperature or a second decomposition temperature or both, the first yarn and the second yarn forming interlocking knit stitches, and forming an array of knitted patterns in the first layer with the first yarn, the array of knitted patterns defining voids in the first layer, the voids passing through the first layer to the second layer, where a portion of the yarn of the second layer is exposed through the voids in the first layer.

In one aspect, a method of manufacturing a knitted textile is disclosed.

In some embodiments, the method includes providing a knitted structure with a first layer having a first yarn with a first thermoplastic composition and a second layer opposite the first layer and integrally formed with the first layer, the second layer having a second yarn having a second composition, the first layer comprising an array of knitted patterns formed with the first yarn, the array of knitted patterns defining voids in the first layer, the voids passing through the first layer and to the second layer, wherein a portion of the yarn of the second layer is exposed through the voids in the first layer, and heating the first layer to at least partially melt the first thermoplastic composition.

In some embodiments, the first thermoplastic composition has a first melting temperature, and the second composition has a second melting temperature or second decomposition temperature or both.

In embodiments, the first melting temperature is at least 5 degrees celsius lower than the lowest of the second melting temperature and second decomposition temperature. In embodiments, the first melting temperature is at least 10 degrees celsius lower than the lowest of the second melting temperature and second decomposition temperature. In embodiments, the first melting temperature is at least 15 degrees celsius lower than the lowest of the second melting temperature and second decomposition temperature. In embodiments, the first melting temperature is at least 20 degrees celsius lower than the lowest of the second melting temperature and second decomposition temperature.

In certain embodiments, the method further includes heating the first layer to a temperature above the first melting temperature and below the lowest of the second melting temperature and second decomposition temperature to at least partially melt the first thermoplastic composition.

In one aspect, methods of manufacturing an article of footwear are disclosed.

In some embodiments, the method includes providing a knitted structure having a first layer comprising a first yarn, the first yarn comprising a first thermoplastic composition having a first melting temperature, and a second layer located on the opposite side of the knitted textile from the first layer and integrally formed with the first layer. The second layer comprises a second yarn formed of a second composition having a second melting temperature or a second decomposition temperature or both, the first yarn and the second yarn forming interlocking knit stitches. The first layer comprises an array of knitted patterns formed with the first yarn, the array of knitted patterns defining voids in the first layer. The voids pass through the first layer and to the second layer, wherein a portion of the yarn of the second layer is exposed through the voids in the first layer. The first melting temperature is lower than the lowest of the second melting temperature and second decomposition temperature. The method further comprises forming the knitted structure into an upper, heating a portion of the first layer to a temperature above the first melting temperature and below the lowest of the second melting temperature and second decomposition temperature to at least partially melt the first thermoplastic composition and to form a film on the first layer. The method further comprises attaching the upper to an outsole to form an article of footwear.

In embodiments, the first melting temperature is at least 5 degrees celsius below the lowest of the second melting temperature and second decomposition temperature. In embodiments, the first melting temperature is at least 10 degrees celsius below the lowest of the second melting temperature and second decomposition temperature. In embodiments, the first melting temperature is at least 15 degrees celsius below the lowest of the second melting temperature and second decomposition temperature. In embodiments, the first melting temperature is at least 20 degrees celsius below the lowest of the second melting temperature and second decomposition temperature.

In some embodiments, the method includes providing a knitted structure having a first layer comprising a first yarn, the first yarn comprising a first thermoplastic composition, the first layer having a first surface comprising a film, the film comprising the first yarn in reflowed form, the film forming an array of fused patterns on the first surface, the array of fused patterns defining voids in the first surface, a second layer located on the opposite side of the knitted structure from the first layer and integrally formed with the first layer, the second layer comprising a second yarn formed of a second composition; the first yarn and the second yarn forming interlocking knit stitches in the second layer and/or in the first layer below the film, the voids passing through the first layer and to the second layer, wherein a portion of the yarn of the second layer is exposed through the voids in the first layer; forming the knitted structure into an upper; and attaching the upper to an outsole to form an article of footwear.

In certain embodiments, the first layer is disposed on the exterior surface of the article of footwear.

BRIEF DESCRIPTION OF THE SEVERAL VIEWS OF THE DRAWINGS

The following drawings are provided to illustrate various embodiments of the disclosure and are not intended to limit the scope of the invention. The components in the Figures are not necessarily drawn to scale.

FIG. 6A illustrates the step of obtaining a textile sample for testing.

FIG. 6B illustrates the step of cutting and positioning one or more textile samples for tensile and strain testing.

FIG. 6C illustrates the step of assessing the Load vs. axial displacement of a textile sample.

FIG. 6D illustrates the equation for determining Poisson's ratio for the various textile samples.

FIG. 6E illustrates the step of plotting the load vs. axial displacement data of a textile sample.

FIG. 6F illustrates the step of determining Poisson's ratio for various textile samples.

FIG. 6G. illustrates a textile sample in an unstretched condition, where there is no strain and no displacement.

FIG. 8 illustrates average stiffness (N/mm) and Poisson's ratio as measured in three orientations for these knitted textile swatches before and after heat treatment, including representative images for the swatches at extension=mm and 50 mm.

DETAILED DESCRIPTION

Figure 1B:
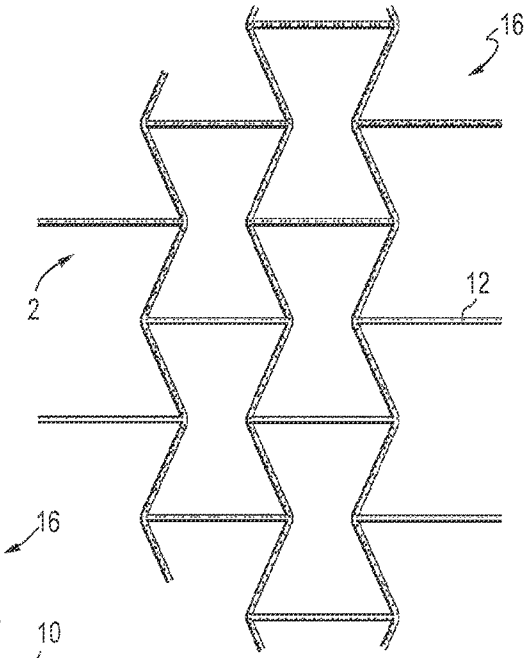
FIGS. 1A, 1B and 1C illustrate various knitted patterns used in embodiments of the knitted textiles herein.

Described herein are textiles 2 having a first layer 4, and a second layer 6 integrally formed with the first layer 2, with voids 8 in the first layer 4 to the second layer 6, the textiles providing unique tensile properties, particularly in certain orientations. Also described are articles of apparel and sporting equipment incorporating such textiles.

Headings are provided solely for the convenience of the reader, and should not be construed as limiting the scope of the disclosure or the appended claims.

The term "textile" or "textile component," as used herein, includes knitted, woven, and nonwoven fabrics or cloth. While frequent reference is made herein to "knitted textile", "knitted upper," and the like, it is understood that other textiles may also be employed in certain embodiments.

The term "article of apparel," as used herein, refers to any article of footwear or garment configured to be worn on a human. Examples of articles of apparel thus include shoes, boots, helmets, hats, caps, shirts, pants, shorts, and sleeves, as well as numerous other products configured to be worn on a person.

The term "sporting equipment" as used herein refers to any article used primarily in the conduct of sporting activities and which may be formed using textile manufacturing processes similar or identical to those used with articles of apparel, as provided herein. Examples of sporting equipment suitable in particular embodiments include knee pads, footballs, baseballs, elbow pads, backpacks, duffel bags, cinch sacks, and straps.

In one aspect, a knitted textile 2 with a knitted structure 10 is disclosed.

In embodiments, a knitted structure 10 includes a first layer 4 including a first yarn 12 and a second layer 6 including a second yarn 14, the first layer 4 integrally formed with the second layer 6.

As used herein, the term "integrally formed" means that a first layer 4 and a second layer 6 of a textile are formed as part of a substantially continuous mechanical process (i.e., as a one-piece element), as opposed to the first layer 4 and second layer 6 being formed as separate structures that are subsequently attached to one another (e.g., through subsequent stitching, bonding, adhesion, etc.). An integrally formed textile may be formed as a one-piece element without the need for significant additional manufacturing steps or processes. This process benefits from reduced waste of material associated with forming separate knit structures and subsequently attaching them, among other advantages.

In a preferred embodiment, the integrally formed textile is an integrally formed knitted textile 2. Any knitting process known in the art may be used, including flat knitting, circular knitting, etc. Thus, in some embodiments, a first layer 4 and a second layer 6 of a knitted textile 2 are integrally formed using interlocking knit stitches involving a first yarn 12 and a second yarn 14. This does not exclude other and additional components being integrally formed with a first layer 4 and/or a second layer 6 and/or attached to a first layer 4 and/or a second layer 6. Similarly, additional yarns may be present in some embodiments of the knitted textile 2.

The terms "preferred" and "preferably" herein refer to embodiments of the invention that may afford certain benefits, under certain circumstances. However, other embodiments may also be preferred, under the same or different circumstances. Furthermore, the recitation of one or more preferred embodiments does not imply that other embodiments are not useful and is not intended to exclude other embodiments from the scope of the present disclosure.

In some embodiments, the second layer 6 is on the opposite side of the first layer 4. In some embodiments, an additional (third, fourth, etc.) layer is present either between a first layer 4 and second layer 6 or adjacent to the first layer 4 and/or second layer 6. The additional layer(s) may be integrally formed with the first layer 4 and/or second layer 6, as through using interlocking knit stitches, or the additional layer(s) may be subsequently attached to a first layer 4 and/or second layer 6, as through subsequent use of stitching, adhesives, or other bonding methods.

Because it is understood that a first layer 4 and a second layer 6 will have a length (x), width (y), and a depth (z), various features of the first layer 4 or second layer 6 may be characterized in any combination of these dimensions. In some embodiments, a first layer 4 has a first surface 34. As used herein, the term "first surface" means an imaginary planar surface positioned parallel to the z axis of, for example, a first layer 4, and essentially resting along the most superficial boundary of the first layer 4. For example, a first surface 34 of a first layer 4 of a knitted textile 2 may refer to an imaginary plane resting on the outermost boundary of the first yarns 12 of the first layer 4. Conversely, the expressions "in a first layer" or "in a second layer" may refer to a region within the first layer 4 or second layer 6 of the knitted textile, including a first yarn 12 or second yarn 14, respectively.

In embodiments herein, the first layer 4 is substantially discontinuous. As used herein when referring to a layer of the knitted textile 2, the term "discontinuous" refers to the presence of significant areas (i.e., larger than the area between adjacent stitches of a typical knitted material) where a yarn is not present in the given layer of the textile, or at least where a yarn is not present on a first surface 34 of the textile. These areas define voids in, for example, the first layer 4. In embodiments herein, the voids 8 act as openings or windows to an underlying second layer 6.

Figure 1C:
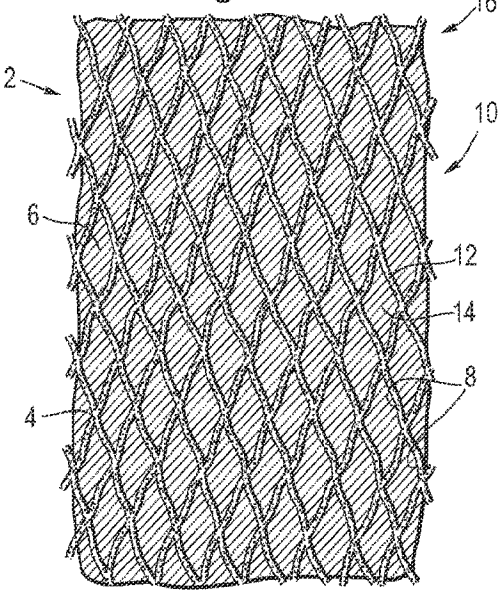
Figure 1A:
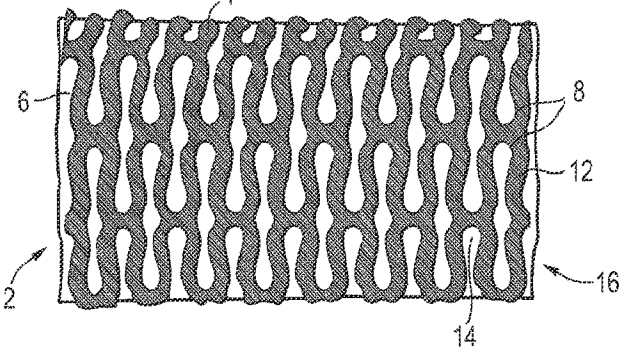

In embodiments, an array of knitted patterns 16 are utilized for the knitted textiles 2 disclosed herein. Illustrative examples of some of these knitted patterns 16 are shown in FIGS. 1A, 1B and 1C, including: rectangular patterns with voids 8 having a slit-like shape (FIG. 1A), bow-tie patterns with voids 8 having a reentrant shape (FIG. 1B), and polygonal patterns with voids 8 having a roughly hexagonal shape (FIG. 1C). Various amorphous constructions are also possible. The term "reentrant," as used herein, refers to a structure with an interior angle greater than 180 degrees. The "bowtie" patterns in FIG. 1B illustrate a reentrant shape.

The term "array" refers to the presence of multiple, repeating knitted patterns, visible especially in the first layer 4 of a knitted textile 2. In preferred embodiments, the array of knitted patterns 16 is formed primarily by a first yarn 12 in a first layer 4. The knitted textiles 2 in FIGS. 1A, 1B and 1C demonstrate different arrays of knitted patterns 16, each illustrating unique architecture and potentially unique directional properties.

In each embodiment in FIGS. 1A, 1B and 1C, the array of knitted patterns 16 are continuous and interconnected in the first layer 4. As used herein when referring to an array of knitted patterns, the term "continuous" refers to a knitted textile 2 in which adjacent knitted patterns 16 are connected in the first layer 4. Thus, in some embodiments, the array of knitted patterns 16 are continuous and interconnected in the first layer 4.

In some embodiments, the array of knitted patterns 16 are discontinuous and not interconnected in the first layer 4. As used herein when referring to an array of knitted patterns, the term "discontinuous" refers to a knitted textile 2 in which adjacent knitted patterns are discrete in a first layer 4, at least as viewed on a first surface 34 of the first layer 4. A discontinuous array of knitted patterns will accordingly appear to not be interconnected in the first layer 4. Even though there may in fact be a continuous course of yarn passing through a second or deeper layer that physically connects adjacent knitted patterns 16 of the knitted textile 2, there may not be physical continuity between adjacent patterns in the first layer 4 or on the first surface 34.

A discontinuous array of knitted patterns 16 may impart unique properties in both the untreated (e.g., non heated) and the treated (e.g., heated) knitted textile 2, as compared to knitted textiles in which the array of knitted patterns are substantially continuous.

Without wishing to be bound to any particular theory, the architecture of the array of knitted patterns 16 (and array of fused patterns after melting) may generally be responsible for the unique tensile properties, anisotropic behavior, and Poisson's ratio of the disclosed knitted textiles 2. As seen in FIGS. 1A, 1B and 1C, the various arrays of knitted patterns 16 have directionally-specific geometry. For example, the bowtie configuration in the middle image of FIG. 1B includes multiple horizontal rows of connected knitted patterns offset from adjacent rows (above and below). The tensile properties of the knitted textile 2 in one axis (i.e., direction or orientation) are likely to differ from the tensile properties in a second axis because of these unusual geometries in the first layer 4. In addition, the unique properties of the disclosed knitted textiles 2, articles of apparel, and sports equipment may be partially due to the interaction of the two or more layers of the knitted textile 2, unusual material compositions, and subsequent processing steps (e.g., heating and reflow).

Figure 5:
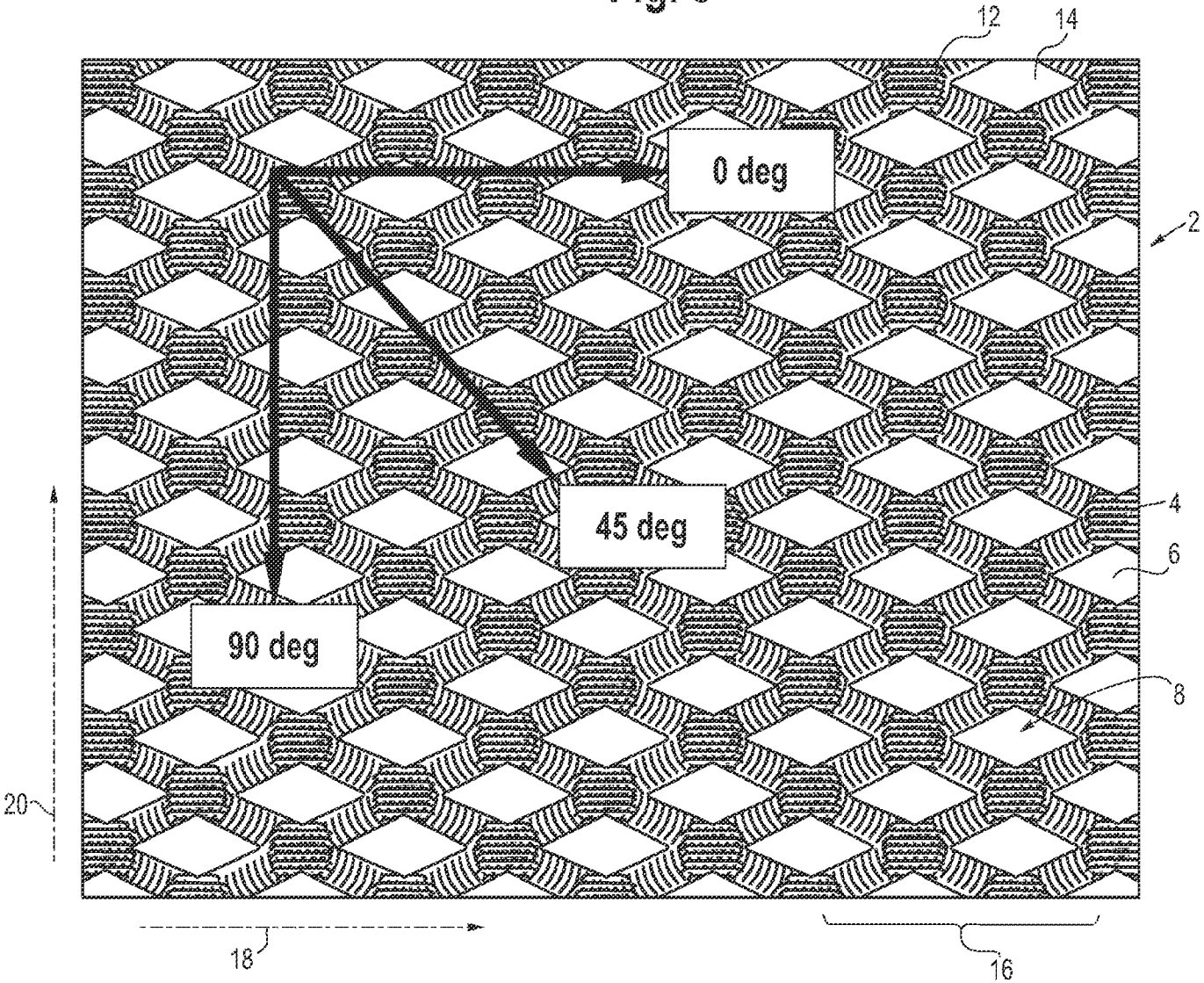
FIG. 5 is an exemplary knitted textile according to certain embodiments herein, showing a cutting/directional pattern used for tensile and strain testing in various orientations.

In some embodiments, as shown in FIG. 5, for example, the knitted textile 2 has a first axis 18 and a second axis 20, the first axis 18 perpendicular to the second axis 20. As used herein, a first axis 18 and a second axis 20 are understood to describe different imaginary reference lines over which a force, such as a tensile force, may be applied to the disclosed textiles, articles of apparel and/or sporting equipment. The orientation of the disclosed textiles, articles of apparel and/or sporting equipment can also be changed with respect to an applied tensile force to present a different axis. In some embodiments, a first axis 18 and a second axis 20 are perpendicular to one another. In some embodiments, the first axis 18 is offset from the second axis 20 by about 5, 10, 15, 20, 25, 30, 35, 40, 45, 50, 55, 60, 65, 70, 75, 80, 85, or 90 degrees, as measured from the smallest intraxial angle. In particular embodiments, the first axis 18 is substantially parallel (0 degrees) to the knitted patterns or fused patterns 16 in the knitted textile 2, and the second axis 20 is substantially perpendicular (90 degrees) to the knitted patterns or fused patterns 16 in the knitted textile 2, as shown generally in FIG. 5.

It is understood that where ranges are disclosed herein, the disclosure encompasses all values up to and including the explicitly disclosed values, as well as all values between those explicitly disclosed values. For example, a disclosed range of 20.0 mm-30.0 mm includes 20.0 mm, 30.0 mm, and all values there between.

Figure 2B:
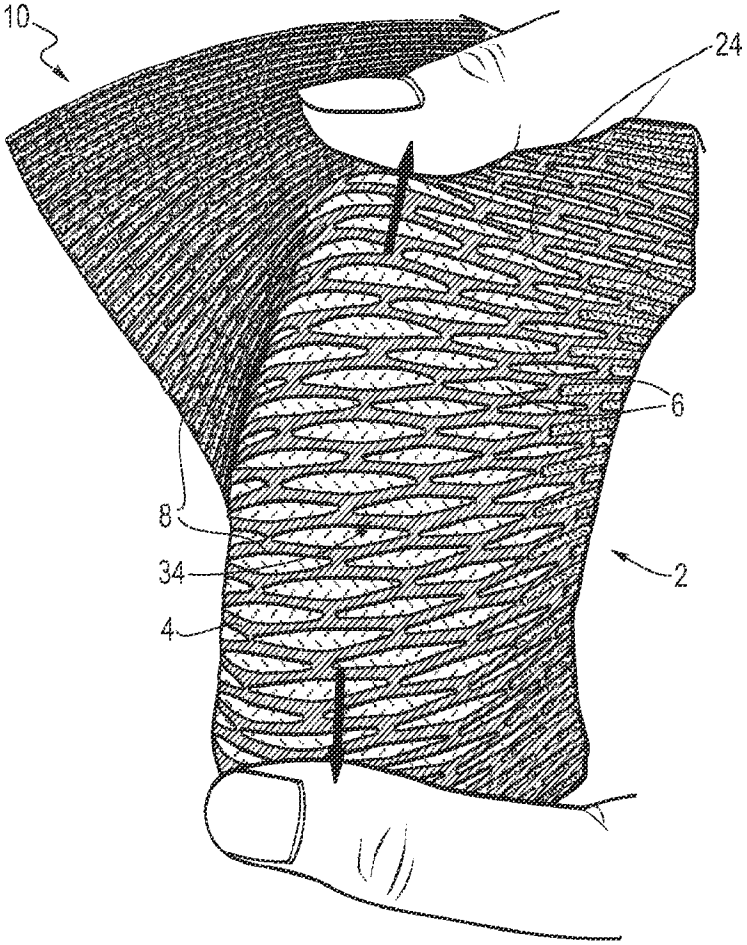
FIG. 2B illustrates stretched knitted textiles according to certain embodiments herein.
Figure 2A:
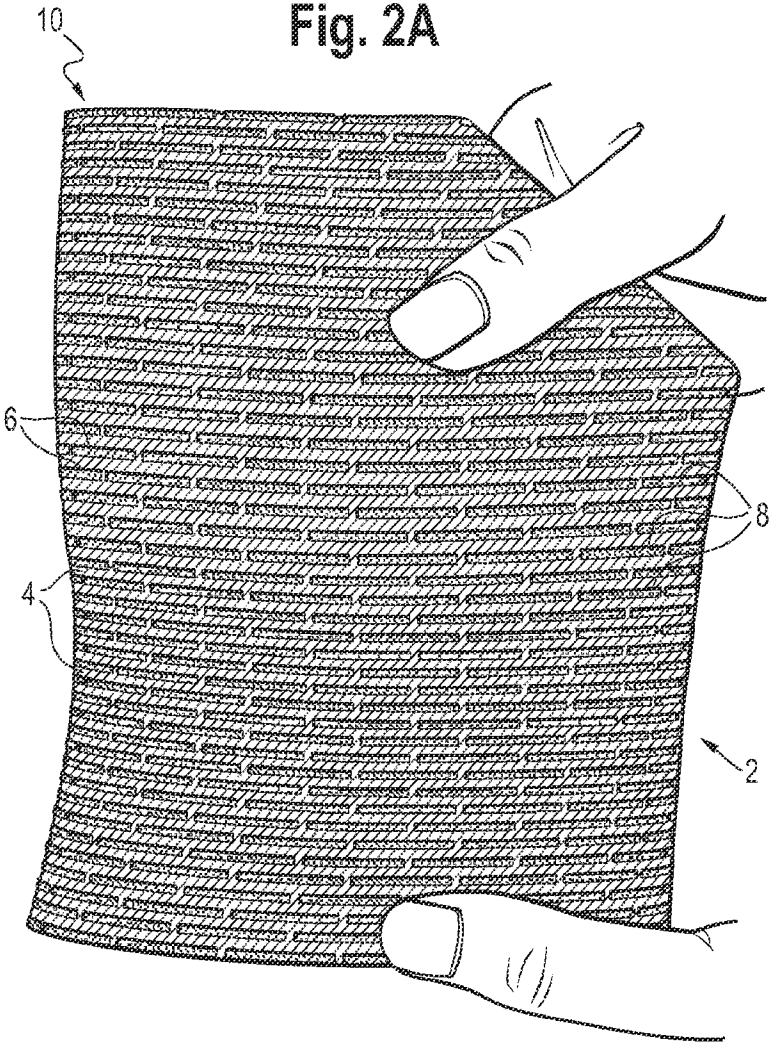
FIG. 2A illustrates unstretched knitted textiles according to certain embodiments herein.

In certain embodiments, an area of the voids 8 in a knitted textile 2 increases to expose more of the second layer 6 when tension in the first axis 18 and/or the second axis 20 is applied to the knitted structure 10. This effect is illustrated in an unstretched condition (FIG. 2A) and a stretched condition (FIG. 2B). In the figures, the first layer 4 has been heat treated to form a film 24 on the first surface 34 (FIG. 2A). The voids 8 may appear having a different visual property, such as a different color or shade. In one example, this could be a lighter color or other contrasting color or texture because of the presence of the second yarn 14 of the underlying second layer 6. A first yarn 12 forms an essentially continuous knitted/fused pattern 16 on the first surface 34 of the first layer 4, defined in this example by the perimeters of the knitted pattern 16 defining the voids 8. It is understood that the knitted pattern 16 in the knitted textile 2 becomes a fused pattern 16 after heat treatment.

In some embodiments, the voids 8 are about four courses wide.

In embodiments, a first yarn 12 comprises a thermoplastic composition. As used herein, a "thermoplastic composition" is a composition that softens or melts when heated at comparatively low temperatures and returns to a solid state when cooled. More particularly, a thermoplastic composition transitions from a solid state to (a) a softened state when heated to a softening temperature of the thermoplastic composition and (b) a generally liquid state when heated to a melting temperature of the thermoplastic composition. When sufficiently cooled, the thermoplastic composition transitions back from the softened or liquid state to the solid state. As such, the thermoplastic composition may be softened or melted, molded, cooled, re-softened or re-melted, re-molded, and cooled again through multiple cycles. When heated to at least the softening temperature, thermoplastic compositions may also be welded, fused, or thermal bonded to other materials. As used herein, the term "reflowed" may refer to a yarn and/or thermoplastic composition that has been heated above its melting point sufficient to allow the thermoplastic composition to melt and flow before potentially returning to a solid state. Various configurations of knitted textiles 2, yarns having thermoplastic compositions, and thermal bonding are described in US2013/0255103, the contents of which are incorporated by reference in their entirety.

Examples of suitable thermoplastic compositions include thermoplastic polyurethane, polyamide, polyester, polypropylene, and polyolefin. Many, but not all, thermoplastic compositions are polymeric materials.

A first yarn 12 may be formed partially or entirely of the thermoplastic composition. In certain embodiments, a first yarn 12 is at least 70%, at least 75%, at least 80%, at least 85%, at least 90(%, at least 95%, at least 99% or entirely (100%) comprised of a thermoplastic composition. Advantages of forming a first yarn 12 substantially entirely from a thermoplastic composition are uniform properties, the ability to easily form thermal bonds, efficient manufacture, elastomeric stretch, and relatively high stability or tensile strength.

Although a first yarn 12 may include any of these thermoplastic compositions, utilizing thermoplastic polyurethane imparts various advantages. For example, various compositions of thermoplastic polyurethane are elastomeric and stretch over one-hundred percent of their resting length, while exhibiting relatively high stability or tensile strength. In comparison with some other thermoplastic polymer materials, thermoplastic polyurethane readily forms thermal bonds with other elements.

Thus, in some embodiments, a thermoplastic composition comprises at least one thermoplastic polyurethane. In certain embodiments, a first yarn 12 may be formed mostly (at least 70%, at least 75%, at least 80%, at least 85%, at least 90%, at least 95%, at least 99%) or entirely (100%) of a thermoplastic polyurethane.

Although a single thermoplastic composition may be utilized, a first yarn 12 may also be formed from multiple thermoplastic compositions. As an example, filaments of a first yarn 12 may have a sheath-core configuration, where an exterior sheath of the individual filament is formed from a first thermoplastic composition and an interior core of the individual filament is formed from a second thermoplastic composition. Conversely, an exterior sheath of the individual filament may be formed from a first thermoplastic composition and an interior core of the individual filament may be formed from a second, non-thermoplastic composition.

As a similar example, an individual filament of the first yarn 12 may have a bi-component configuration, wherein one half (or a portion) of the individual filament is formed from a first thermoplastic composition, and an opposite half (or another portion) of the individual filament is formed from a second thermoplastic composition. Conversely, one half (or a portion) of the individual filament may be formed from a first thermoplastic composition, and an opposite half (or another portion) of the individual filament may be formed from a second, non-thermoplastic composition.

Various other configurations of knitting patterns 16, yarn types, and methods of knitting may be utilized to form a knitted textile 2, including those discussed in WO2014/081680, incorporated by reference in its entirety.

In some embodiments, a yarn comprising a thermoplastic composition is treated (e.g., by heat) to melt the thermoplastic composition, forming a film 24 comprising the yarn in reflowed form. The film 24 comprising this reflowed yarn may be non-filamentous, at least in layers or regions where melting of the yarn comprising a thermoplastic composition is complete. In addition to forming a film 24, the reflowed yarn may form a thermal bond with other parts of the knitted textile 2, such as non-reflowed areas of a first layer 4, a second layer 6, or other components associated with a knitted textile 2. For example, a thermal bond may be formed by the yarn comprising the thermoplastic composition (in non-filamentous form) infiltrating portions of the second layer 6.

In embodiments, a second yarn 14 comprises a second composition. The second composition may be a higher-melting composition, relative to a first (thermoplastic) composition. For example, the second composition may be a thermoset composition. Thermoset compositions may not melt when heated, but instead degrade or decompose. Representative examples of second compositions include cotton, wool, elastane, and nylon.

In embodiments, the first melting temperature is significantly lower than the second melting temperature or decomposition temperature. This ensures that treatment (e.g., heat treatment) of a first yarn 12 comprising a first thermoplastic composition does not also cause melting or decomposition of a second yarn 14 comprising a second composition. In certain embodiments, the first melting temperature is at least 5 degrees, at least 10 degrees, at least 15 degrees, or at least 20 degrees Celsius lower than the lowest of the second melting temperature and second decomposition temperature.

In some embodiments, the second composition comprises a thermoset material that decomposes as it is heated rather than melting. Thus, in certain embodiments, the first melting temperature is at least 5 degrees, at least 10 degrees, at least 15 degrees, or at least 20 degrees Celsius lower than the second decomposition temperature.

In some embodiments, the second composition comprises a thermoplastic material that melts as it is heated rather than (or at a lower temperature than) decomposing. Thus, in certain embodiments, the first melting temperature is at least 5 degrees, at least 10 degrees, at least 15 degrees, or at least 20 degrees Celsius lower than the second melting temperature.

Various methods may also be used to reduce the exposure of a second yarn 14 to the effects of heat treating the first yarn 12, including screening, shielding, application of chemicals (such as water or oil) to one or the other yarn, etc.

Untreated Knitted Textiles

In certain embodiments, a knitted textile 2 having a first layer 4 and a second layer 6, the first layer 4 having an array of knitted patterns 16 defining voids 8 in the first layer 4, the voids 8 extending to the second layer 6, has unique directional tensile properties without further treatment. In certain of these embodiments, the disclosed knitted textile 2 has different properties, such as elastic modulus and Poisson's ratio, when measured in a first axis 18 (or orientation) than when measured in a second axis 20. Thus, the disclosed knitted textiles 2 may have anisotropic properties.

As used herein, the term "anisotropic" refers to a material (e.g., a textile) having a physical property with a different value when measured in different directions. A common example is wood, which is stronger along the grain than across it. The term "isotropic" conversely refers to a material (e.g., a textile) having a physical property with the same or similar values when measured in different directions. As used herein, the term "elastic modulus" may be used interchangeably with the terms "Young's modulus" or "tensile modulus" and generally is the ratio of stress along an axis (force per unit area) vs. strain (proportional deformation) along that same axis.

Anisotropic properties are particularly useful when the disclosed knitted textiles 2 are incorporated into an article of apparel, such as an article of footwear or a garment. In such cases, this anisotropic property may impart a tailored stiffness to the article, with particular regions and directions of stress being stiffer than other regions and directions. Thus, articles of apparel incorporating the knitted textiles 2 exhibit an enhanced and dynamic fit, zonal support, better conformity, and comfort for the user.

Figure 3:
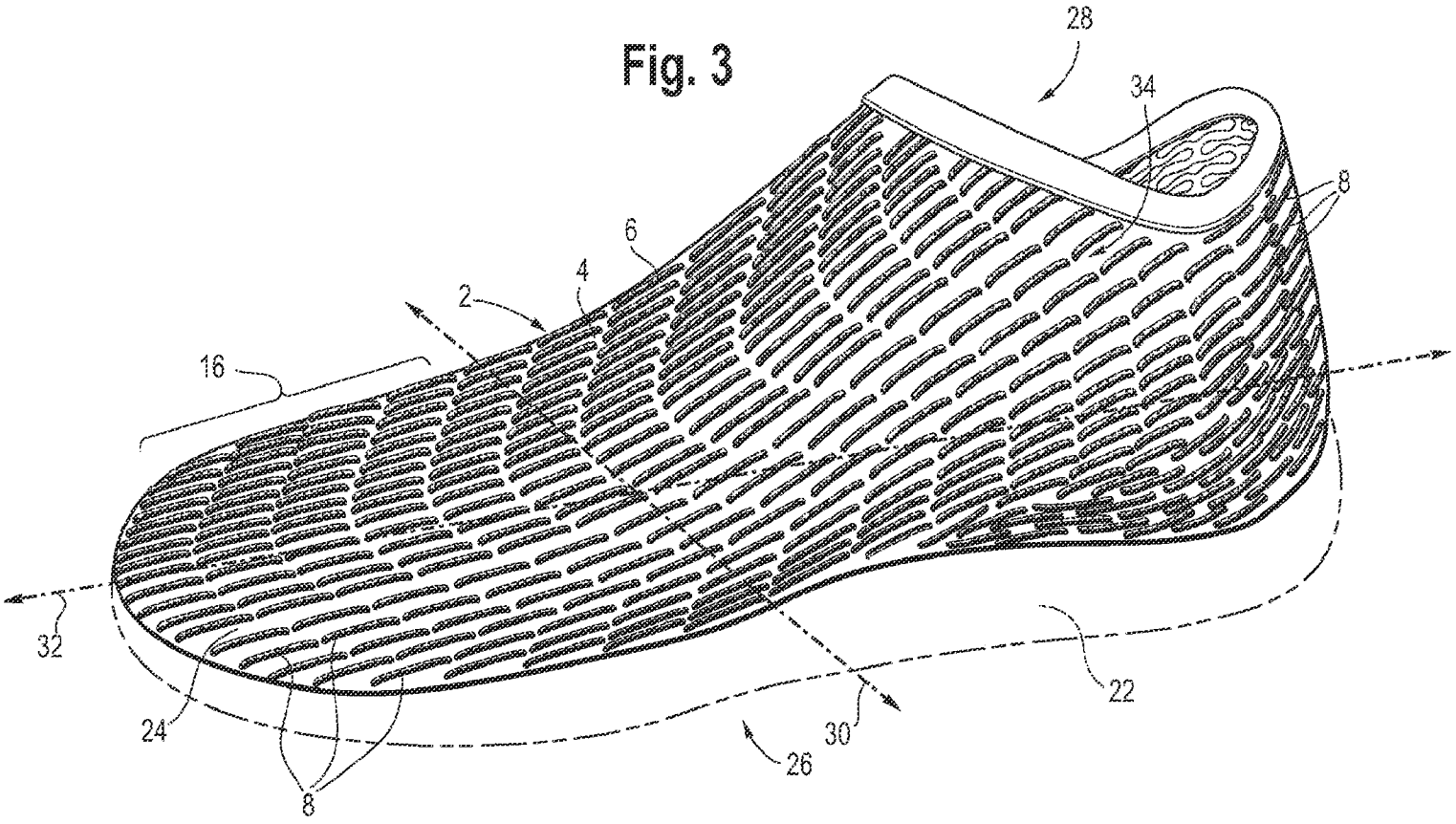
FIG. 3 illustrates a perspective view of a medial side of an article of footwear incorporating a knitted textile upper.
Figure 4:
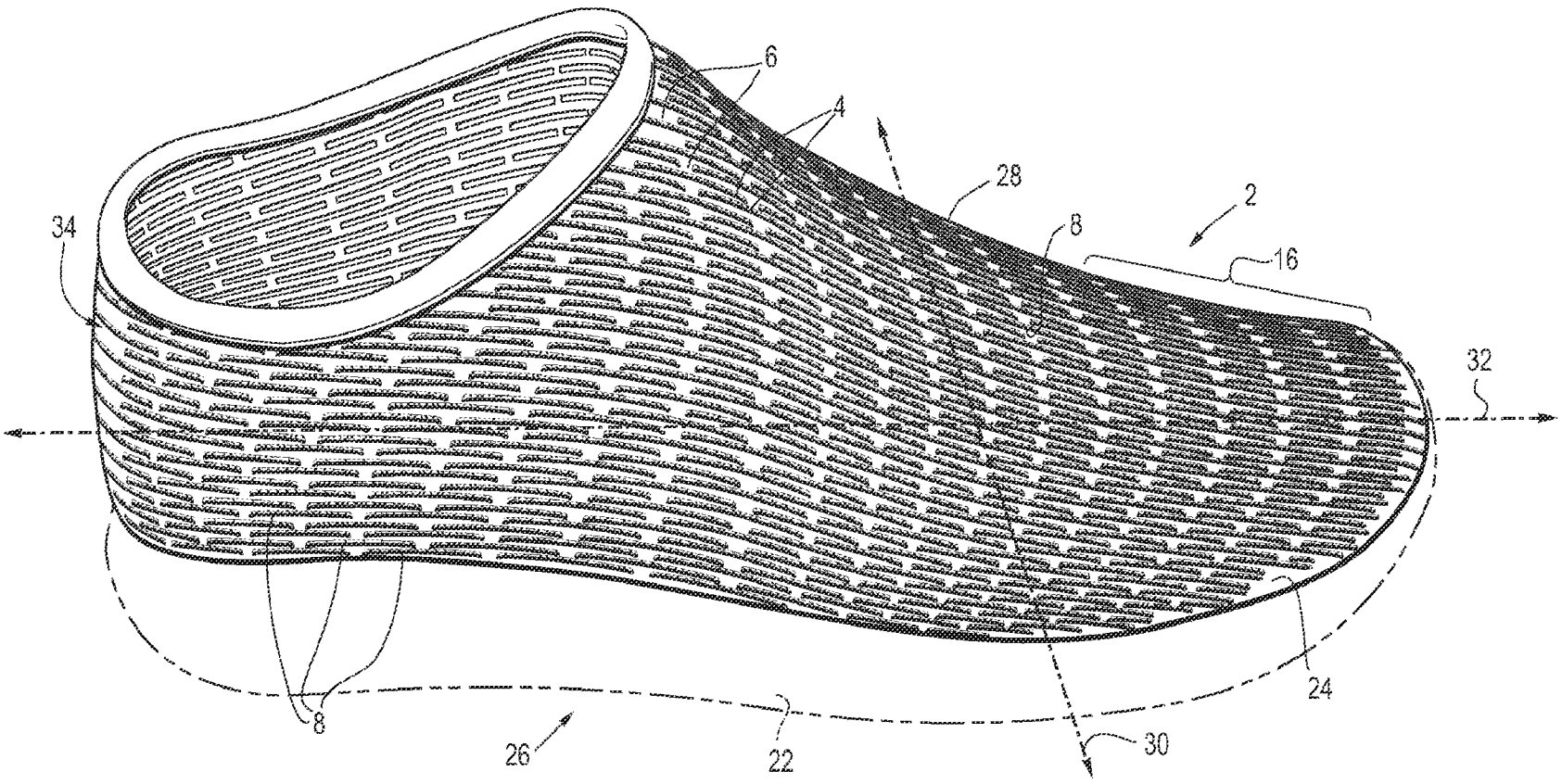
FIG. 4 illustrates a perspective view of a lateral side of an article of footwear incorporating a knitted textile upper.

FIGS. 3 and 4 illustrate two perspectives of an article of footwear 26 incorporating a knitted textile upper 28, according to certain embodiments herein. FIG. 3 illustrates a perspective view of a medial side of an article of footwear 26, while FIG. 4 illustrates the lateral side. The knitted textile 2 shown in FIGS. 3 and 4 has a slit-like knitted pattern 16 formed by a first layer 4 which defines voids 8 to reveal an underlying second layer 6.

Thus, in a specific embodiment, a knitted textile 2 is disclosed with a knitted structure 10 comprising: a first layer 4 of the knitted structure 10 comprising a first yarn 12, the first yarn 12 comprising a first thermoplastic composition having a first melting temperature, the first yarn 12 forming an array of knitted patterns 16 in the first layer 4, the array of knitted patterns 16 defining voids 8 in the first layer 4; a second layer 6 of the knitted structure 10 located on the opposite side of the knitted textile 2 from the first layer 4 and integrally formed with the first layer 4, the second layer 6 comprising a second yarn 14, the first yarn 12 and the second yarn 14 forming interlocking knit stitches; the voids 8 passing through the first layer 4 and to the second layer 6, wherein a portion of the yarn of the second layer 6 is exposed through the voids 8 in the first layer 4; the second yarn 14 formed of a second composition having a second melting temperature or a second decomposition temperature or both, the first melting temperature being lower than the lowest of the second melting temperature and second decomposition temperature.

Treated Knitted Textiles

In embodiments, treatment of the knitted textile 2 facilitates a melting/reflow of a first thermoplastic composition. In a preferred embodiment, this treatment is accomplished by application of heat to the first layer 4. Various methods of applying heat to a textile are known in the art, including heat pressing.

In some embodiments, the properties of a knitted textile 2 change as a result of heat treatment of a first layer 4. For example, heat treatment to form a film in the first layer 4 may protect the second layer 6 from abrasion, while the heat treated first layer 4 may provide improved water resistance.

In specific embodiments, the first layer 4 of a knitted textile 2 has a first surface 34 comprising a film 24, the film 24 comprising a first yarn 12 in reflowed form, the film 24 forming an array of fused patterns 16 on the first surface 34, the array of fused patterns 16 defining voids 8 in the first surface 34.

As used herein, the term "reflowed" means the yarn and/or composition (e.g., thermoplastic composition) exists in a non-filamentous form. For example, a reflowed yarn and/or composition may be heated such that individual filaments of the yarn and/or composition are at least partially melted or fused, the individual filaments losing their filamentous character. Other methods of forming a reflowed composition may be envisioned by those of skill in the art.

Because a second layer 6 of a knitted textile 2 may be integrally formed with a first layer 4, at least some of a second yarn 14 may be present in a first layer 4 or even on a first/exterior surface of the first layer 4. When the first layer 4 is heat treated, some or all of the first yarn 12 having a thermoplastic composition may melt and reflow, while the second yarn 14 present in the first layer 4 does not melt. These non-melted second yarns 14 can pull apart to separate adjacent reflowed portions of the first layer 4 when tension is applied in one or more axis, exposing a larger area of the voids 8 to the second layer 6. The voids 8 also allow for breathability and the fabric to stretch. Further, the voids 8 may be directed downward to channel water in specific areas, as shown by the generally downwardly slanted orientation of the plurality of voids 8, extending from the ankle opening towards the forefoot and/or sole structure 22, seen in FIGS. 2A and 2B.

In certain embodiments, heat treatment significantly increases the stiffness of the knitted textile 2 in a first axis 18, but has negligible effects on stiffness in a second, different axis. In particular embodiments, heat treatment of a first layer 4 of a knitted textile 2 causes the elastic modulus in a first axis 18, a second axis 20, or both, to increase by at least 10%, at least 20%, at least 30%, at least 40%, at least 50%, at least 60%, at least 70%, at least 80% at least 90%, or at least 100%. In embodiments, the knitted textile 2 is thus anisotropic after treatment.

In other embodiments, a textile is isotropic.

In some embodiments, a textile is anisotropic in one region (i.e., zone) and isotropic in another region.

In certain embodiments, heat treatment significantly increases the Poisson's ratio of the knitted textile 2 in a first axis 18 but has negligible effects on the Poisson's ratio in a second, different axis. Poisson's ratio (PR) is the ratio of transverse strain to axial strain. Most materials expand perpendicular to the direction of compression and contract perpendicular to the direction of stretching. For example, when a rubber band is stretched, it becomes noticeably thinner in a direction perpendicular to the direction of stretch. The Poisson's ratio of a stable, isotropic, linear elastic material is between −1.0 and 0.5, but most materials have Poisson's ratios between 0.0 and 0.5 (i.e., a zero or positive Poisson's ratio). An incompressible material deformed elastically at small strains has a Poisson's ratio of exactly 0.5. Rubber has a Poisson's ratio of almost 0.5. Steels and rigid polymers (before yield) have PR's about 0.3. Cork's PR is close to 0, showing very little lateral expansion when compressed.

A knitted textile 2 after heat treatment according to certain embodiments may have a measured Poisson's ratio close to zero in a first axis 18, but a significantly higher (more positive) Poisson's ratio in the same axis after heat treatment of the first layer 4. This same knitted textile 2 may also become substantially stiffer in at least a first axis 18 following heat treatment of the first layer 4. Thus, in particular embodiments, heat treatment of a first layer 4 of a knitted textile 2 causes the Poisson's ratio in a first axis 18, a second axis 20, or both, to change (increase or decrease) by at least 10%, at least 20%, at least 30%, at least 40%, at least 50%, at least 60%, at least 70%, at least 80% at least 90%, or at least 100%. Thus, in a specific embodiment, a knitted textile 2 is disclosed with a knitted structure 10 comprising: a first layer 4 of the knitted structure 10 comprising a first yarn 12, the first yarn 12 comprising a first thermoplastic composition, the first layer 4 having a first surface 34 comprising a film 24, the film 24 comprising the first yarn 12 in reflowed form, the film 24 forming an array of fused patterns 16 on the first surface 34, the array of fused patterns 16 defining voids 8 in the first surface 34, a second layer 6 of the knitted structure 10 located on the opposite side of the knitted textile 2 from the first layer 4 and integrally formed with the first layer 4, the second layer 6 comprising a second yarn 14 formed of a second composition; the first yarn 12 and the second yarn 14 forming interlocking knit stitches in the second layer 6 and/or in the first layer 4 below the film 24; the voids 8 passing through the first layer 4 and to the second layer 6, wherein a portion of the yarn of the second layer 6 is exposed through the voids 8 in the first layer 4.

In embodiments herein, the knitted textile 2 does not have auxetic properties, either before or after heat treatment. Conversely, in some embodiments, a knitted textile 2 may have auxetic properties before and/or after heat treatment of the first layer 4 in at least a first axis 18. In certain embodiments, a knitted textile 2 and/or an article of apparel 26 incorporating a knitted textile 2 has auxetic properties before and/or after heat treatment.

As used herein, the term "auxetic" generally means a material with a negative Poisson's ratio. In some cases, a material will shrink in the transverse direction when compressed (or expand in the transverse direction when stretched) yielding a negative Poisson's ratio. When stretched, an auxetic material thus becomes thicker perpendicular to the applied force. This typically occurs due to the way an auxetic material's internal structure deforms when the sample is uniaxially loaded.

Auxetic behavior can be useful in areas where a drape-like fit is desired, without bunching or folding at irregular contours. Auxetic materials may be particularly suited for areas of articles of apparel where conformation to irregular shapes is desired.

In this manner, the use of particular knitted patterns 16 in a given orientation, different yarns and compositions, and differing heat treatment of the knitted textile 2 (e.g., first layer), allows an operator to tailor zonally and directionally-specific properties in the knitted textile 2. For example, the operator can modify any of these conditions and locally control conformability, modulus/stiffness, or draping properties.

In some embodiments, a first layer 4 is treated only in a portion of the knitted textile 2, with other portions remaining untreated. In this way, a significant anisotropy may be created between the different portions of the knitted textile 2 (or an article of apparel or sporting equipment incorporating the knitted textile).

In further embodiments, textures may be added to the first layer 4. For example, during the heat pressing process, different release papers may be used to prevent the pressing member from sticking to the first layer. Release papers may include texture or designs (waves, ribs, etc.) that may be pressed into the first layer 4 and thereby impart texture.

Each of these properties of the knitted textile 2, before and after heat treatment, can be incorporated into articles of apparel and sports equipment. For example, a knitted textile 2 incorporated into an upper 28 for an article of footwear 26 may be heat treated such that the upper 28 has a negative Poisson's ratio in a toe to heel direction, but is very stiff from biteline to collar.

Alternative Configurations

It is also possible to form a knitted textile 2, article of apparel, or sporting equipment with a first layer 4 and a second layer 6, using only one yarn having a thermoplastic composition, instead of two or more yarns in the knitted textile 2. In embodiments, heat treatment of only the first layer 4 of the knitted textile 2 causes melting or reflow of the thermoplastic composition (and yarn) in only the first layer 4, with minimal involvement of the underlying second layer 6.

Thus, in one aspect, a knitted textile 2 includes a knitted structure 10 formed from a yarn having a thermoplastic composition, the knitted structure 10 having a first layer 4 and a second layer 6, the yarn forming an array of knitted patterns 16 in the first layer 4, the array of knitted patterns 16 defining voids 8 in the first layer 4 and passing through the first layer 4 and to the second layer 6, wherein a portion of the yarn of the second layer 6 is exposed through the voids 8 in the first layer 4.

In embodiments, heating the first layer 4 above a melting temperature or decomposition temperature of the thermoplastic composition causes at least a partial melting of the yarn in the first layer 4.

In another aspect, a knitted textile 2 includes a knitted structure 10 formed from a yarn having a thermoplastic composition, the knitted structure 10 having a first layer 4 and a second layer 6, the first layer 4 having a first surface 34 comprising a film 24, the film 24 comprising the first yarn 12 in reflowed form, the film 24 forming an array of fused patterns 16 in the first layer 4, the array of fused patterns 16 defining voids 8 in the first layer 4 and passing through the first layer 4 and to the second layer 6, wherein a portion of the yarn of the second layer 6 is exposed through the voids 8 in the first layer 4.

Various methods are also known in the art for selective heat treatment of only a portion, section, or depth of a textile, including blocking, masking, and the use of chemicals that either promote or minimize temperature changes in the textile. Use of a single yarn type may simplify the manufacturing process and reduce some waste associated with knitted textiles 2 incorporating multiple yarn types.

Layered Textiles

In one aspect, a textile is formed by layering, embroidering, printing, bonding, strapping, screening, laminating, or otherwise attaching (collectively referred to as a "layered textile") a second layer 6 of material onto a first layer 4, the first layer 4 comprising a first yarn 12 including a first thermoplastic composition, the second layer 6 comprising a second yarn 14 including a second composition.

In this aspect, a first layer 4 and a second layer 6 of the layered textile are not integrally formed, but are formed as separate structures that are later attached. In embodiments, the second layer 6 of the layered textile is located after attachment on the opposite side of the layered textile from the first layer 4.

Each of the first layer 4 and second layer 6 may be separately formed through knitting, woven, or nonwoven processes. In embodiments, the first yarn 12 forms an array of knitted patterns 16 in the first layer 4, the array of knitted patterns 16 defining voids 8 in the first layer 4, the voids 8 passing through the first layer 4 and to the second layer 6, wherein a portion of the yarn of the second layer 6 is exposed through the voids 8 in the first layer 4.

In embodiments, heat treatment of the first layer 4 of a layered textile causes the first thermoplastic composition to reflow, forming a film 24 on a first surface 34 of the first layer 4. In some embodiments, heat treatment of a layered textile significantly increases the Poisson's ratio of the layered textile in a first axis 18, but has negligible effects on the Poisson's ratio in a second, different axis. Similarly, in certain embodiments, heat treatment of a layered textile significantly increases the stiffness of the layered textile in a first axis 18, but has negligible effects on stiffness in a second, different axis. In this manner, the use of particular knitted patterns 16 in a given orientation, different yarns and compositions, and differing heat treatment of the first layer 4, allows an operator to tailor zonally- and directionally-specific properties in the knitted textile 2.

Articles of Apparel and Sporting Equipment

In some embodiments, the knitted textile 2 is incorporated into an article of apparel 26. In embodiments, an article of apparel is an article of footwear or a garment. In some embodiments, the knitted textile 2 forms a portion of an article of footwear 26. In certain embodiments, the knitted textile 2 forms all or a portion of an upper 28 for an article of footwear 26. In some embodiments, the knitted textile 2 forms a portion of a sporting equipment. The term "portion" means the knitted textile 2 may represent 10%, 20%, 30%, 40%, 50%, 60%, 70%, 80%, 90%, or 100% of the article of apparel or sporting equipment.

Thus, in a specific embodiment, an article of footwear 26 includes an upper 28 and a sole structure 22, the upper 28 including a knitted textile 2 with a knitted structure 10 comprising: a first layer 4 of the knitted structure 10 comprising a first yarn 12, the first yarn 12 comprising a first thermoplastic composition, the first layer 4 having a first surface 34 comprising a film 24, the film 24 comprising the first yarn 12 in reflowed form, the film 24 forming an array of fused patterns 16 on the first surface 34, the array of fused patterns 16 defining voids 8 in the first surface 34, a second layer 6 of the knitted structure 10 located on the opposite side of the knitted textile 2 from the first layer 4 and integrally formed with the first layer 4, the second layer 6 comprising a second yarn 14 formed of a second composition; the first yarn 12 and the second yarn 14 forming interlocking knit stitches in the second layer 6 and/or in the first layer 4 below the film 24; the voids 8 passing through the first layer 4 and to the second layer 6, wherein a portion of the yarn of the second layer 6 is exposed through the voids 8 in the first layer 4.

In certain embodiments, the article of footwear 26 has a first footwear axis 30 and a second footwear axis 32, the first footwear axis 30 oriented medial to lateral on the article of footwear 26 and the second footwear axis 32 oriented from toe to heel on the article of footwear 26.

In certain embodiments, the first layer 4 is disposed on the exterior surface of the article of footwear 26.

Methods of Forming Textiles and Articles

In one aspect, a method for forming a knitted textile 2 is disclosed.

In some embodiments, the method includes knitting a knitted structure 10 comprising a first layer 4 comprising a first yarn 12, the first yarn 12 having a first thermoplastic composition with a first melting temperature, and a second layer 6 located on the opposite side of the knitted textile 2 from the first layer 4 and integrally formed with the first layer 4, the second layer 6 comprising a second yarn 14 formed of a second composition having a second melting temperature or a second decomposition temperature or both, the first yarn 12 and the second yarn 14 forming interlocking knit stitches, and forming an array of knitted patterns 16 in the first layer 4 with the first yarn 12, the array of knitted patterns 16 defining voids 8 in the first layer 4, the voids 8 passing through the first layer 4 and to the second layer 6, wherein a portion of the yarn of the second layer 6 is exposed through the voids 8 in the first layer 4.

In embodiments, the first melting temperature is at least 5 degrees, at least 10 degrees, at least 15 degrees, or at least 20 degrees Celsius lower than the lowest of the second melting temperature and second decomposition temperature.

In some embodiments, the first layer 4 is heated to a temperature above the first melting temperature and below the lowest of the second melting temperature and second decomposition temperature, to at least partially melt the first thermoplastic composition.

In certain embodiments, the melted first thermoplastic composition forms a film 24 on the first layer 4.

In one aspect, a method of manufacturing a knitted textile 2 is disclosed.

In embodiments, the method includes: providing a knitted structure 10, the knitted structure 10 comprising a first layer 4 comprising a first yarn 12, the first yarn 12 comprising a first thermoplastic composition having a first melting temperature, and a second layer 6 located on the opposite side of the knitted textile 2 from the first layer 4 and integrally formed with the first layer 4, the second layer 6 comprising a second yarn 14 formed of a second composition having a second melting temperature or a second decomposition temperature or both, the first yarn 12 and the second yarn 14 forming interlocking knit stitches, the first layer 4 comprising an array of knitted patterns 16 formed with the first yarn 12, the array of knitted patterns 16 defining voids 8 in the first layer 4, the voids 8 passing through the first layer 4 and to the second layer 6, wherein a portion of the yarn of the second layer 6 is exposed through the voids 8 in the first layer 4, the first melting temperature being lower than a lowest of the second melting temperature and second decomposition temperature; and heating the first layer 4 to a temperature above the first melting temperature and below the lowest of the second melting temperature and second decomposition temperature, to at least partially melt the first thermoplastic composition.

In some embodiments, the first layer 4 of the knitted textile 2 is thus raised to a temperature at or above the melting temperature of the first thermoplastic material. For example, heat (or heat and pressure) may be applied directly to the first layer 4 of the knitted textile 2 by contacting the first layer 4 of the knitted textile 2 with a heated plate. In embodiments, the temperature of the first layer 4 of the knitted structure 10 is raised for a duration of time sufficient to form a non-filamentous film 24 on at least a portion of the first layer 4. Thus, in some embodiments, the melted first thermoplastic composition forms a film 24 on the first layer 4.

In particular embodiments, the knitted textile 2 is further incorporated into an article of apparel, such as an article of footwear or a garment. In particular embodiments, the knitted textile 2 is further incorporated into an upper 28 for an article of footwear 26. In specific embodiments, the upper 28 is further attached to a sole structure 22 of an article of footwear 26. Various methods of attaching the upper 28 to the sole are known in the art, but it is also possible to thermally bond the upper 28 to the sole by heat melting the thermoplastic composition.

In one aspect, a method for manufacturing an article of footwear 26 is disclosed.

In some embodiments, the method comprises providing a knitted structure 10, the knitted structure 10 including a first layer 4 comprising a first yarn 12, the first yarn 12 comprising a first thermoplastic composition having a first melting temperature, and a second layer 6 located on the opposite side of the knitted textile 2 from the first layer 4 and integrally formed with the first layer 4, the second layer 6 comprising a second yarn 14 formed of a second composition having a second melting temperature or a second decomposition temperature or both, the first yarn 12 and the second yarn 14 forming interlocking knit stitches, the first layer 4 comprising an array of knitted patterns 16 formed with the first yarn 12, the array of knitted patterns 16 defining voids 8 in the first layer 4, the voids 8 passing through the first layer 4 and to the second layer 6, wherein a portion of the yarn of the second layer 6 is exposed through the voids 8 in the first layer 4, forming the knitted structure 10 into an upper 28; heating a portion of the first layer 4 to a temperature above the first melting temperature and below the lowest of the second melting temperature and the second decomposition temperature to at least partially melt the first thermoplastic composition and to form a film 24 on the first layer 4; and attaching the upper 28 to an outsole to form an article of footwear 26.

In embodiments, the first melting temperature is lower than the lowest of the second melting temperature and second decomposition temperature. In certain embodiments, the first melting temperature is at least 5 degrees, at least 10 degrees, at least 15 degrees, or at least 20 degrees Celsius lower than the lowest of the second melting temperature and second decomposition temperature.

In some embodiments, a first axis 18 is oriented medial to lateral on the article of footwear 26, and a second axis 20 is oriented from toe to heel on the article of footwear 26.

In specific embodiments, the Poisson's ratio of the knitted textile 2 is greater than or equal to zero when measured in the first axis 18, the second axis 20, or both.

In some embodiments, the first layer 4 is disposed on the exterior surface of the article of footwear 26.

In one aspect, a method of forming an article of footwear 26 is disclosed.

In some embodiments, the method includes providing a knitted structure 10, the knitted structure 10 comprising a first layer 4 comprising a first yarn 12, the first yarn 12 comprising a first thermoplastic composition, the first layer 4 having a first surface 34 comprising a film 24, the film 24 comprising the first yarn 12 in reflowed form, the film 24 forming an array of fused patterns 16 on the first surface 34, the array of fused patterns 16 defining voids 8 in the first surface 34, a second layer 6 located on the opposite side of the knitted structure 10 from the first layer 4 and integrally formed with the first layer 4, the second layer 6 comprising a second yarn 14 formed of a second composition; the first yarn 12 and the second yarn 14 forming interlocking knit stitches in the second layer 6 and/or in the first layer 4 below the film 24, the voids 8 passing through the first layer 4 and to the second layer 6, wherein a portion of the yarn of the second layer 6 is exposed through the voids 8 in the first layer 4; forming the knitted structure 10 into an upper 28; and attaching the upper 28 to an outsole to form an article of footwear 26.

In some embodiments, a first axis 18 is oriented medial to lateral on the article of footwear 26, and a second axis 20 is oriented from toe to heel on the article of footwear 26.

In specific embodiments, the Poisson's ratio of the knitted textile 2 is greater than or equal to zero when measured in the first axis 18, the second axis 20, or both.

In some embodiments, the first layer 4 is disposed on the exterior surface of the article of footwear 26.

The following examples are provided to illustrate certain particular features and/or aspects. The examples should not be construed to limit the disclosure to the particular features or aspects described therein.

EXAMPLES

Knitted textiles 2 were formed with an array of knitted patterns 16 in the first layer 4 and voids 8 passing from the first layer 4 to a second layer 6. The knitted textile 2 may be incorporated in footwear (e.g., in uppers), garments, sporting equipment, etc.

Example 1

A knitted textile 2 is formed having a Poisson's ratio greater than or equal to zero when measured in a first axis 18, a second axis 20, or both. The knitted textile 2 is anisotropic after heat treatment of the first layer 4.

A knitted textile 2 was integrally formed with a first layer 4 including a first yarn 12 having a thermoplastic composition and a second layer 6 including a second yarn 14. In this example, the first yarn 12 was SAMBU TPU yarn (950 Denier, black color) with a TPU-coated polyester monofilament. The second yarn 14 was PIS yarn (150 Denier, orange color) including one strand of textured polyester yarn (P16) air tacked to one strand of 20D spandex. In the knitted textile 2, the second layer 6 is located on the opposite side of the knitted textile 2 from the first layer 4 and the first yarn 12 and the second yarn 14 form interlocking knit stitches within the knitted textile 2. Thus, the majority of the yarn present in the first layer 4 is the first yarn 12 and the majority of the yarn present in the second layer 6 is the second yarn 14, although owing to the nature of the knitting process, a small amount of the first yarn 12 will be present in the second layer 6 (forming interlocking stitches) and a small amount of the second yarn 14 will be present in the first layer 4.

In the knitted textile 2, the first yarn 12 forms an array of knitted patterns 16 defining voids 8 in the first layer 4. These knitted patterns 16 appear as black, roughly rectangular structures defining voids 8 with a generally slit-like appearance. Voids 8 in the first layer 4 expose the underlying second yarn 14 of the second layer 6. In this example, the array of knitted patterns 16 are continuous and interconnected in the first layer 4. After heat treatment of the first layer 4, the array of knitted patterns 16 becomes an array of fused patterns 16 on a first surface 34 of the first layer 4.

Stiffness and Poisson's Ratio Testing.

Figure 6:
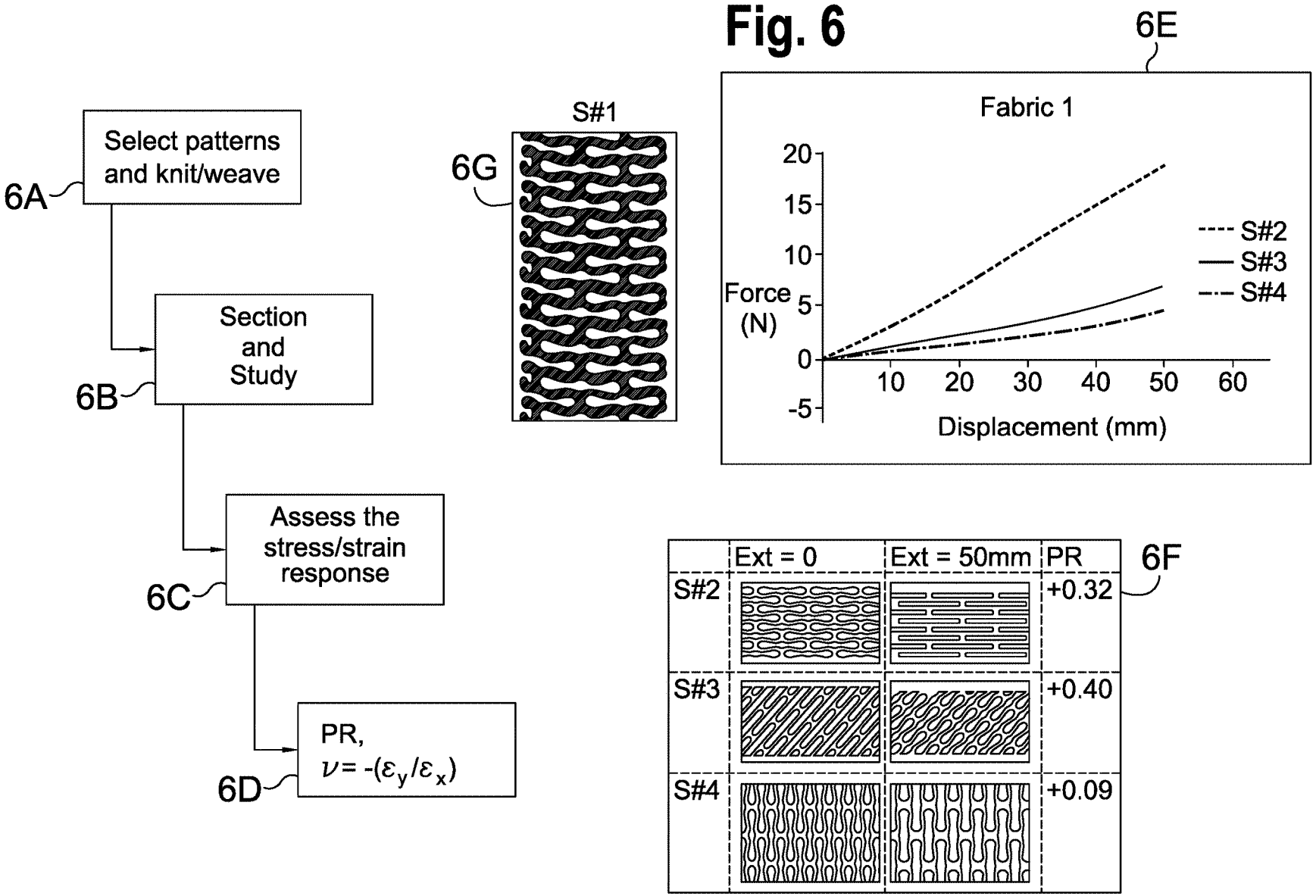
FIG. 6 illustrates a schematic illustrating stress and strain testing of knitted textiles according to certain embodiments herein.

Tensile and strain testing was conducted to measure stiffness (N/mm) and Poisson's ratio (PR) using swatches of knitted textiles 2 before and after heat treatment, as shown generally in FIG. 6.

Knitted textile samples were obtained as shown in FIGS. 6A, 6F and 6G. As shown in FIG. 6B, strips of approximately 1"×6" were cut and positioned for tensile and strain testing in 0, 45, or 90 degree orientations relative to the knitting direction. Also see FIG. 5, illustrating similar orientations for a different knit pattern. Test samples were marked with fiducial markers using a black marker pen, white liquid correction fluid, or retro-reflex pen. For some fabrics, clearly-defined fabric features were employed in the strain analysis.

As generally shown in FIG. 6C and FIG. 6E, various samples (identified in FIG. 6 as S #1, S #2, S #3 and S #4, were tested in an Instron 3367 mechanical testing machine fitted with a 30 kN load cell, at an axial displacement rate of 50 mm/min, at up to 50 mm total extension. High resolution photographs were taken every 5 seconds using a Canon SD Mark II digital camera with 100 mm macro lens. Load vs. axial displacement data were obtained directly from the Instron. Stiffness was determined as the slope of the best fitting straight line of load vs. axial displacement data, in the range of 0 mm to 50 mm displacement. FIG. 6G, for example, shows a textile sample (S #1) in an unstretched condition, where there is no strain and no displacement. Transverse strain and axial strain were determined from the coordinates of the fiducial dots or fabric features measured from the photographs using Image) image analysis software. Poisson's ratio (PR) was taken, as shown in FIG. 6D and FIG. 6F, from the slope of the best fitting straight line to the transverse strain vs. axial strain in the range of 0-30% strain. Thus, FIGS. 6A-6D illustrate a schematic for stress and strain testing, including evaluating tensile strength as a function of elongation in multiple directions (0, 45, 90) and the resulting orthogonal strain response used to determine Poisson's ratio.

A second round of testing was conducted. Four retro-reflex marks were placed on the sample. Samples were tested in an Instron mechanical testing machine. An Olympus high speed video camera was used to record image at 60 frames per second during Instron testing. Load vs axial displacement data were obtained. Stiffness was evaluated as the slope of the best fitting straight line of load vs axial displacement data in the range of 3% to 30% axial strain. Transverse strain and axial strain were determined from the marker coordinates using the Olympus tracking software. Poisson's ratio was calculated from the slope of the best fitting straight line to the transverse strain vs axial strain in the range of 0-20% strain.

A third round of testing was conducted. Samples were tested in an Instron 5960 mechanical testing machine fitted with a 500 N load cell, at axial displacement rate of 100 mm/min, up to 30% strain. Load vs. axial displacement data were taken directly from the Instron. Stiffness was the slope of the best fitting straight line of load vs axial displacement data in a range of 3% to 30% strain.

Textile samples were evaluated in untreated form and treated form. Treatment entailed application of heat to the first layer 4 of the knitted textile sample. The temperature of the first layer 4 of the knitted structure 10 was raised to a temperature at or above the melting temperature of the first thermoplastic material. The temperature of the first layer 4 of the knitted structure 10 was raised by applying a heating plate with pressure to the first layer 4 of the textile sample until a non-filamentous film 24 formed on the first layer 4.

Figure 7:
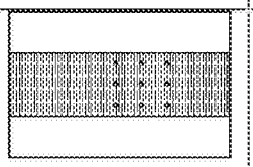
FIG. 7 illustrates average stiffness (N/mm) and Poisson's ratio in three orientations for knitted textile swatches before and after heat treatment, including representative images for the swatches at extension=0 mm and extension=50 mm.
Figure 7:
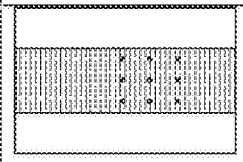
Figure 7:
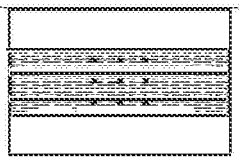
Figure 7:
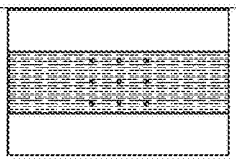
Figure 7:
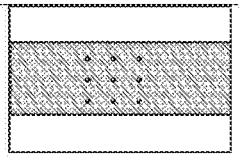
Figure 7:
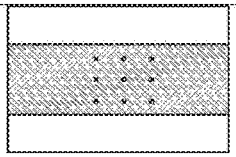
Figure 7:
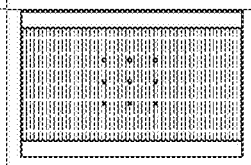
Figure 7:
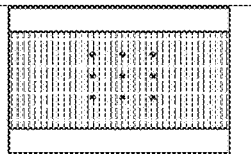
Figure 7:
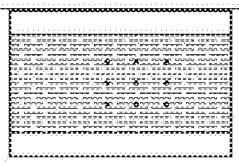
Figure 7:
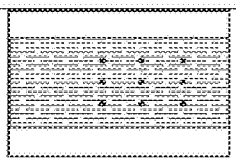
Figure 7:
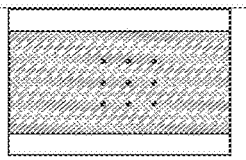
Figure 7:
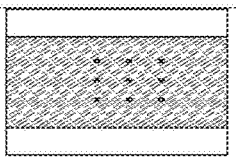

FIG. 7 shows average stiffness (N/mm) and Poisson's ratio in three orientations for knitted textile swatches before and after heat treatment, including representative images for the swatches at extension=0 mm and extension=50 mm.

The data in FIG. 7 illustrates that use of thermoplastic composition yarn (e.g., TPU) plus post-knit thermal treatment (reflow) of the thermoplastic composition increased stiffness and Poisson's ratio in all orientations tested, with Poisson's ratio close to zero or positive in all orientations (before and after treatment).

Example 2

A second knitted textile 2 was formed with significantly increased stiffness in all orientations after heat treatment of the first layer 4, while preserving a Poisson's ratio greater than zero when measured in certain orientations.

The knitted textile 2 was integrally formed with a first layer 4 including a first yarn 12 having a thermoplastic composition and a second layer 6 including a second yarn 14. In this example, the first yarn 12 was Edge 2 fused knit yarn (3 strands P15 yarn and 1 strand of KE60 low melt yarn). The second yarn 14 was Edge 2 unfused knit yarn (3 strands K15 yarns).

Stiffness and Poisson's ratio was measured as described in Example 1 and shown in FIG. 7. FIG. 8 shows average stiffness (N/mm) and Poisson's ratio as measured in three orientations for these knitted textile swatches before and after heat treatment, including representative images for the swatches at extension=0 mm and 50 mm.

Example 3

A third knitted textile was formed with very high stiffness in some orientations after heat treatment of the first layer 4.

The knitted textile 2 was integrally formed with a first layer 4 including a first yarn 12 having a thermoplastic composition and a second layer 6 including a second yarn 14, as described in Example 1. In this example, the first yarn 12 included one strand of KE85 low melt yarn. The second yarn 14 included six strands of P15 yarn.

Stiffness was measured as described in Example 1 above. Table 1 below shows average stiffness (N/mm) in three orientations for these knitted textile swatches after heat treatment.

TABLE 1

Test Result of Fused Pl5-KE85 Fused Bowtie Knit.

| | Orientation | Stiffness (N/mm) |
|---|---|---|
| Fused | 0° | 0.04 |
| | 90° | 2.70 |
| | 45° | 0.06 |

Use of KE85 low melt yarn plus post-knit thermal treatment of the low melt yarn yielded very high stiffness in some orientations with knit swatches.

Although the present disclosure has been described with reference to preferred embodiments, workers skilled in the art will recognize that changes may be made in form and detail without departing from the spirit and scope of the disclosure.

What is claimed is:

1. A knitted textile with a knitted structure, comprising:

a first layer of the knitted structure comprising a first yarn, the first layer having a first surface comprising a film, the film comprising the first yarn in reflowed form, the film forming an array of fused patterns on the first surface, the array of fused patterns defining voids in the first surface, a second layer of the knitted structure located on the opposite side of the knitted textile from the first layer and integrally formed with the first layer, the second layer comprising a second yarn;

the first yarn and the second yarn forming interlocking knit stitches in the second layer and/or in the first layer adjacent the film;

the voids passing through the first layer and to the second layer, wherein a portion of the second yarn of the second layer is exposed through the voids in the first layer, wherein the first yarn has a first melting temperature, and the second yarn has a second melting temperature or a second decomposition temperature, and the first melting temperature is lower than the lowest of the second melting temperature and the second decomposition temperature.

2. The knitted textile of claim 1, wherein the first melting temperature is at least 5 degrees Celsius lower than the lower of the second melting temperature and the second decomposition temperature.

3. The knitted textile of claim 1, wherein at least 90% of the first yarn is formed from a first thermoplastic composition, and wherein the second yarn is formed from a second composition.

4. The knitted textile of claim 1, wherein a surface area of the voids increases to expose more of the second layer when tension is applied to the knitted structure.

5. The knitted textile of claim 1, wherein the array of fused patterns are discontinuous in the first layer.

6. The knitted textile of claim 1, wherein the knitted structure has a first axis and a second axis, the first axis being perpendicular to the second axis.

7. The knitted textile of claim 6, wherein a Poisson's ratio of the knitted textile is greater than or equal to zero when measured along the first axis, along the second axis, or along both.

8. The knitted textile of claim 6, wherein a Poisson's ratio of the knitted textile is less than zero when measured along the first axis or along the second axis.

9. An article of footwear comprising an upper and a sole structure, the upper comprising a knitted textile with a knitted structure, the knitted structure comprising:

a first layer of the knitted structure comprising a first yarn, the first layer having a first surface comprising a film, the film comprising the first yarn in reflowed form, the film forming an array of fused patterns on the first surface, the array of fused patterns defining voids in the first surface, a second layer of the knitted structure located on the opposite side of the knitted textile from the first layer and integrally formed with the first layer, the second layer comprising a second yarn;

the first yarn and the second yarn forming interlocking knit stitches in the second layer and/or in the first layer adjacent the film;

the voids passing through the first layer and to the second layer, wherein a portion of the second yarn of the second layer is exposed through the voids in the first layer, wherein the first yarn has a first melting temperature, and the second yarn has a second melting temperature or a second decomposition temperature or both, the first melting temperature being lower than the lowest of the second melting temperature and the second decomposition temperature.

10. The article of footwear of claim 9, wherein the knitted structure has a first axis and a second axis, the first axis being perpendicular to the second axis.

11. The article of footwear of claim 10, wherein the first axis is oriented medial-to-lateral on the article of footwear, and the second axis is oriented from toe-to-heel on the article of footwear.

12. The article of footwear of claim 10, wherein a Poisson's ratio of the knitted textile is greater than or equal to zero when measured along the first axis, along the second axis, or along both.

13. The article of footwear of claim 10, wherein a Poisson's ratio of the knitted textile is less than zero when measured along the first axis or along the second axis.

14. The article of footwear of any one of claim 9, wherein the first layer is disposed on an exterior surface of the article of footwear.

15. A method of manufacturing an article of footwear, the method comprising:

forming a knitted structure of a knitted textile, the knitted structure comprising:

a first layer comprising a first yarn, the first yarn comprising a first melting temperature, and a second layer located on the opposite side of the knitted textile from the first layer and integrally formed with the first layer, the second layer comprising a second yarn comprising a second melting temperature or a second decomposition temperature or both, the first yarn and the second yarn forming interlocking knit stitches, the first layer comprising an array of knitted patterns formed with the first yarn, the array of knitted patterns defining voids in the first layer, the voids passing through the first layer and to the second layer, wherein a portion of the second yarn of the second layer is exposed through the voids in the first layer, the first melting temperature being lower than the lowest of the second melting temperature and the second decomposition temperature;

forming the knitted structure into an upper;

heating a portion of the first layer to a temperature above the first melting temperature and below the lowest of the second melting temperature and the second decomposition temperature to at least partially melt the first yarn to form a film on the first layer; and attaching the upper to an outsole.

16. The method of claim 15, wherein the knitted structure has a first axis and a second axis, the first axis being perpendicular to the second axis.

17. The method of claim 16, wherein the first axis is oriented medial-to-lateral on the article of footwear, and the second axis is oriented from toe-to-heel on the article of footwear.

18. The method of claim 17, wherein a Poisson's ratio of the knitted textile is greater than or equal to zero when measured along the first axis, along the second axis, or along both.

19. The method of claim 17, wherein a Poisson's ratio of the knitted textile is less than zero when measured along the first axis or along the second axis.

20. The method of claim 15, wherein the first melting temperature is at least 5 degrees Celsius lower than the lowest of the second melting temperature and the second decomposition temperature.

* * * * *